US006818315B2

(12) United States Patent
Lintunen et al.

(10) Patent No.: US 6,818,315 B2
(45) Date of Patent: Nov. 16, 2004

(54) METHOD FOR THE MANUFACTURE OF A METAL MATRIX COMPOSITE, AND A METAL MATRIX COMPOSITE

(75) Inventors: Pertti Lintunen, Tampere (FI); Pekka Lintula, Tampere (FI); Tomi Lindroos, Tampere (FI); Anssi Jansson, Lappeenranta (FI); Simo-Pekka Hannula, Helsinki (FI)

(73) Assignee: Valtion Teknillinen Tutkimuskeskus, Espoo (FI)

( * ) Notice: Subject to any disclaimer, the term of this patent is extended or adjusted under 35 U.S.C. 154(b) by 0 days.

(21) Appl. No.: 10/451,119

(22) PCT Filed: Dec. 20, 2001

(86) PCT No.: PCT/FI01/01142

§ 371 (c)(1),
(2), (4) Date: Jun. 19, 2003

(87) PCT Pub. No.: WO02/053316

PCT Pub. Date: Jul. 11, 2002

(65) Prior Publication Data

US 2004/0038053 A1 Feb. 26, 2004

(30) Foreign Application Priority Data

Dec. 20, 2000 (FI) ..... 20002790
May 28, 2001 (FI) ..... 20011105

(51) Int. Cl.[7] ..... B22F 3/23; B32B 15/04; C22C 1/00; C22C 1/05; C22C 29/00

(52) U.S. Cl. ..... 428/472.1; 428/539.5; 75/236; 148/421; 148/437

(58) Field of Search ..... 428/472.1, 539.5; 75/236; 148/421, 437

(56) References Cited

U.S. PATENT DOCUMENTS 4,673,550 A 6/1987 Dallaire et al.
4,738,389 A * 4/1988 Moshier et al. ..... 228/198
4,751,048 A * 6/1988 Christodoulou et al. .... 420/129
4,988,480 A 1/1991 Merzhanov et al.
5,194,237 A * 3/1993 Cliche et al. ..... 423/440
5,217,816 A 6/1993 Brupbacher et al.
6,203,897 B1 * 3/2001 Koizumi et al. ..... 428/336
6,436,480 B1 * 8/2002 Upadhya ..... 427/450
6,521,353 B1 * 2/2003 Majagi et al. ..... 428/565
6,573,210 B1 * 6/2003 Claussen et al. ..... 501/127
6,652,616 B1 * 11/2003 Berns et al. ..... 75/236

FOREIGN PATENT DOCUMENTS

| | | |
|---|---|---|
| EP | 0253497 | 1/1988 |
| EP | 0731186 | 9/1996 |
| EP | 0987511 | 3/2000 |
| RU | 1790094 | 2/1995 |
| SE | 192178 | 10/1964 |
| WO | 90/07013 | 6/1990 |

* cited by examiner

*Primary Examiner*—John J. Zimmerman
*Assistant Examiner*—Jason L Savage
(74) *Attorney, Agent, or Firm*—Venable LLP; Eric J. Franklin

(57) ABSTRACT

A method for the manufacture of a metal matrix composite by the SHS technique comprises a reaction between titanium and carbon or between titanium and borium, forming titanium carbide or titanium diboride. Tantalum and molybdenum or chromium are blended to the raw materials of the metal matrix composite to improve the resistance of the metal matrix composite to high temperatures and/or corrosion. The invention also relates to a metal matrix composite which contains elements at whose presence a protective oxide layer is formed on the surface of the metal matrix composite during the use.

12 Claims, No Drawings

METHOD FOR THE MANUFACTURE OF A METAL MATRIX COMPOSITE, AND A METAL MATRIX COMPOSITE

The present invention relates to a method for the manufacture of a metal matrix composite comprising titanium carbide by the SHS technique comprising steps of: Selecting a raw material basis, mixing a binder with the raw material basis to form a mixture, and igniting the mixture to form the metal matrix composite. The invention also relates to a metal matrix composite made by the SHS technique and comprising titanium carbide, and a metallic binder or an intermetallic binder material.

Known sintered hard metals, such as the mixture of tungsten carbide and cobalt (WC—Co) and the mixture of tungsten carbide and nickel (WC—Ni), are applied in uses requiring a particularly wear-resistant material. However, these materials have the problem of poor resistance to high temperatures. Under conditions of a high temperature, the surface of a hard metal is oxidized, and as it is often subjected to mechanical stresses as well, the material will begin to wear fast. Problems are caused at a temperature as low as about 500° C.

EP 0401374 discloses a method for making a composite comprising preparing a mixture and igniting it. As examples are mentioned for example a mixture containing titanium, chromium, carbon, titanium nitride and nicrome, and a mixture containing titanium, chromium, carbon and 20% by mass chromium, nickel, carbon and iron. The composite is used for cutting tools, hard alloy tooling, and dies.

The SHS technique (self-propagating high-temperature synthesis) refers to a manufacturing method, in which a reaction of strong production of heat is caused between powderized starting materials by heating the raw materials locally to a light-off temperature. As a result of the reaction, a new compound is obtained. By the SHS technique it is possible to produce, in a fast and inexpensive way, metal matrix composites with a very good wear resistance, such as metal matrix composites based on titanium carbide or titanium diboride. The problem is, however, their resistance to corrosion and resistance at high temperatures.

As an example, it can be mentioned that a metal matrix composite based on titanium carbide is destroyed and becomes useless at a temperature exceeding 1000° C.

By the method according to the invention, it is possible to produce mixtures whose resistance to high temperatures and/or corrosion is substantially better than that of materials of prior art. The method according to the invention is characterized in that 0.6 to 1.0 atoms of titanium and 0.1 to 0.4 atoms of chromium per 0.9 to 1.1 carbon atoms are measured, or 0.6 to 1.0 atoms of titanium, 0.6 to 1.0 atoms of tantalum and 0.1 to 0.3 atoms of molybdenum per 0.9 to 1.1 carbon atoms are measured, and the binder is selected among aluminum-containing metallic binders, or aluminum-containing intermetallic binder materials when the raw material basis includes chromium, or the binder is selected among aluminum-containing metallic binders, aluminum-containing intermetallic binder materials, or chromium-containing metallic binders when the raw material basis includes tantalum and molybdenum. The metal matrix composite according to the invention is characterized in that the metal matrix composite further comprises either a) chromium and a binder selected among aluminum-containing metallic binders, or aluminum-containing intermetallic binder materials, or b) tantalum, molybdenum, and a binder selected among aluminum-containing metallic binders, chromium-containing metallic binders, or aluminum-containing intermetallic binder materials, and a protective oxide layer builds up on the surface of the metal matrix composite during its use in a temperature range from 500° C. to 1200° C.

By the method according to the invention, it is possible to manufacture metal matrix composites which are resistant at temperatures of 1200° C.; in other words, they can be used to cover the range from 500 to 1200° C. They also have a good corrosion resistance at temperatures lower than those mentioned above.

The metal matrix composite materials made by the SHS technique can be utilized in all components which are subjected to wear at high temperatures. The SHS hard metals are considerably tougher than ceramic materials. The materials are fit for use at oxidizing conditions up to a temperature of at least 1200° C. They can be used, for example, in components of burners at power plants, such as in burner indents or nozzles. A large variety of uses for materials with such a combination of properties can also be found in the processing industry, for example in oil refining or other chemical industry, particularly at uses subjected to corrosion.

By the SHS manufacturing technique, it is possible to produce solid pieces or powderized substances of the metal matrix composite material, to be used for example in thermal spraying or laser coating. The solid pieces are made by compressing a mass, which is warm and plastic after the exothermic reaction, to a dense component in a mould; in other words, the SHS technique can be used to make a form piece directly from powderized raw materials. The powders are made by allowing the mass to cool down without compression, wherein a porous material is formed, which is ground by methods known as such.

The metal matrix composite is made by the SHS technique by allowing titanium and chromium, or titanium, tantalum and molybdenum, in doses suitable for the reaction, to react with carbon or borium. Normally, when titanium is compounded with chromium, 0.6 to 1.0 atoms of titanium and 0.1 to 0.4 atoms of chromium are used per 0.9 to 1.1 carbon atoms. When titanium is compounded with tantalum and molybdenum, 0.6 to 1.0 atoms of titanium. 0.1 to 0.3 atoms of tantalum and 0.1 to 0.3 atoms of molybdenum are used per 0.9 to 1.1 carbon atoms.

Before the reaction is started, other substances, such as metallic binders or binders between metals in powder form are normally added into the mixture. Metallic binders or binders between metals act as substances giving strength and toughness to the ready metal matrix composite, and they have good oxidation stability. Metallic binders or binders between metals normally constitute 10 to 70 weight percent of the total mass of the raw materials of the metal matrix composite. Advantageous binders include mixtures containing iron, chromium and aluminum (FeCrAl mixtures) or mixtures containing nickel and chromium (NiCr mixtures) or mixtures containing nickel and aluminum (Ni—Al mixtures) or mixtures containing nickel, chromium and aluminum (NiCrAl).

An FeCrAl based binder normally contains 4 to 20 wt-% of aluminum, 10 to 30 wt-% of chromium and the rest of iron in the binder. In addition, the binder may contain 0.001 to 2 weight percent of reactive elements or their oxides, such as zirconium (Zr) or zirconium oxide ($ZrO_2$), yttrium (Y) or yttrium oxide ($Y_2O_3$), lanthanum (La), cerium (Ce), thorium (Th), rhenium (Re), rhodium (Rh), or titanium (Ti). Furthermore, the binder may contain silicon carbide (SiC) or molybdenum silicide ($MoSi_2$). As an FeCrAl based binder, it is possible to use, for example, a superalloy marketed under the trade name APM (Kanthal AB, Sweden). An FeCrAl based binder is normally used in high temperature applications of the metal matrix composite. As a NiCr based binder, it is possible to use, for example, a superalloy marketed under the trade name Inconel 625 (High Performance Alloys, Inc., USA). NiCr based binders are normally used in such applications of the metal matrix composite, in which the corrosion resistance is important. Advantageous metal compounds include nickel aluminides (NiAl or $Ni_3Al$). Cobalt (Co) may be added in any of the above-mentioned metallic binders or binders between metals.

Advantageous raw material compositions include the following:

Titanium and chromium are allowed to react with carbon, and the binder is a mixture of nickel and chromium (NiCr).

Titanium and chromium are allowed to react with carbon, and the binder is a mixture of iron, chromium and aluminum (FeCrAl), with a possible addition of zirconium oxide ($ZrO_2$).

Titanium and chromium are allowed to react with carbon, and the binder is a mixture of iron, chromium and aluminum (FeCrAl), with an addition of silicon carbide (SiC) or zirconium oxide ($ZrO_2$) or both.

Titanium, tantalum and molybdenum are allowed to react with carbon, and the binder is a mixture of nickel and chromium, with an addition of silicon carbide (SiC) or molybdenum silicide ($MoSi_2$).

The hardness of the above-mentioned materials is typically 800 to 1500 HV, but hardness values up to 1800 HV can be achieved with these materials. The content of the carbide phase in the metal matrix composite according to the invention is 40 to 90 volume percent, typically 60 to 80 volume percent. At the best, the increase in the weight of the above-mentioned materials in oxidation tests at 1200° C. has been similar to that of the best metal high-temperature superalloys. In a corresponding test, the commercial Inconel 625 material is destroyed and becomes useless. Considering the very high hardness of high-temperature SHS mixtures in comparison with metal superalloys (for example, 150 HV of APM mixture), the metal matrix composite according to the invention provides a new type of materials to be used, for example, in components of power plants which are exposed to hot erosion. When the corresponding material is used in powder form, it can be used to form a very dense coating on another material.

The resistance of the metal matrix composite according to the invention at high temperatures or in uses subjected to corrosion is based on the fact that during the use, a protective oxide coating is formed on the surface of the metal matrix composite, which coating can be detected on the surface of the material by microscopy. A requirement for the formation of the protective layer is that there are elements present in the surface of the metal matrix composite which affect the formation of the layer. The surface must contain an element which is capable of forming an oxide layer. Such elements include, for example, aluminum, chromium and silicon. These elements are advantageously blended both in the carbide phase and in the metallic binder or the intermetallic binder material, so that a uniform oxide layer is formed on the surface. Silicon oxide ($SiO_2$), which is formed as a result of silicon present, is capable of forming a very dense oxide layer as a protection from oxidation and corrosion and which also has an advantageous effect on the stability of other oxides forming an oxide layer, such as aluminum and chromium oxides, under the conditions of use. If tantalum and molybdenum or chromium are blended in the raw materials of the metal matrix composite, normally in its carbide phase, the protective oxide layer is formed as a layer with an even thickness of typically 1 to 50 $\mu$m, with a very good protecting effect.

Metal matrix components resistant to high temperatures were achieved by the SHS technique by using the following raw materials and raw material ratios:

EXAMPLE 1

0.8 atoms of titanium and 0.2 atoms of chromium were used per one carbon atom. In addition, 40% of the mass of the mixture consisted of a binder containing 63.5 wt-% of iron (Fe), 21 wt-% of chromium (Cr), 15 wt-% of aluminum (Al), and 0.5 wt-% of zirconium (Zr).

EXAMPLE 2

0.8 atoms of titanium and 0.2 atoms of chromium were used per one carbon atom. In addition, 40% of the mass of the mixture consisted of a binder. The binder contained 63.5 wt-% of iron (Fe), 21 wt-% of chromium (Cr), 15 wt-% of aluminum (Al), and 0.5 wt-% of zirconium (Zr). Five weight percent of the mass of the mixture consisted of silicon carbide (SiC).

EXAMPLE 3

0.8 atoms of titanium and 0.2 atoms of chromium were used per one carbon atom. In addition, 30% of the mass of the mixture consisted of a binder containing 63.5 wt-% of iron (Fe), 21 wt-% of chromium (Cr), 15 wt-% of aluminum (Al), and 0.5 wt-% of zirconium (Zr).

EXAMPLE 4

0.75 atoms of titanium and 0.25 atoms of chromium were used per one carbon atom. In addition, 40% of the mass of the mixture consisted of a binder containing 63.5 wt-% of iron (Fe), 21 wt-% of chromium (Cr), 15 wt-% of aluminum (Al), and 0.5 wt-% of zirconium (Zr).

EXAMPLE 5

0.75 atoms of titanium and 0.25 atoms of chromium were used per one carbon atom. In addition, 40% of the mass of the mixture consisted of a binder which was Inconel 601 (a commercial NiCr based mixture, High Performance Alloys, Inc., USA).

EXAMPLE 6

0.8 atoms of titanium, 0.1 atoms of tantalum and 0.1 atoms of molybdenum were used per one carbon atom. In addition, 40% of the mass of the mixture consisted of a binder containing 63.5 wt-% of iron (Fe), 21 wt-% of chromium (Cr), 15 wt-% of aluminum (Al), and 0.5 wt-% of zirconium (Zr).

EXAMPLE 7

0.8 atoms of titanium, 0.1 atoms of tantalum and 0.1 atoms of molybdenum were used per one carbon atom. In addition, 40% of the mass of the mixture consisted of a binder which was Inconel 601 (a commercial NiCr based mixture, High Performance Alloys, Inc., USA).

It is claimed:

1. A method for the manufacture of a metal matrix composite comprising titanium carbide by the SHS technique, the method comprising:

selecting a raw material basis by a) measuring 0.6 to 1.0 atoms of titanium and 0.1 to 0.4 atoms of chromium per 0.9 to 1.1 carbon atoms, or b) measuring 0.6 to 1.0 atoms of titanium, 0.1 to 0.3 atoms of tantalum and 0.1 to 0.3 atoms of molybdenum per 0.9 to 1.1 carbon atoms, mixing a binder with the raw material basis to form a mixture, the binder being selected among aluminum-containing metallic binders, or aluminum-containing intermetallic binder materials when the raw material basis includes chromium, or the binder being selected among aluminum-containing metallic binders, aluminum-containing intermetallic binder materials, or chromium-containing metallic binders when the raw material basis includes tantalum and molybdenum, igniting the mixture to form the metal matrix composite.

2. The method according to claim 1, wherein the amount of the metallic binder or the intermetallic binder material is 10–70 wt.-%.

3. The method according to claim 1, wherein the aluminium-containing metallic binder is a mixture containing iron (Fe), chromium (Cr) and aluminum (Al).

4. The method according to claim 1, wherein the aluminium-containing metallic binder is a mixture containing nickel (Ni) and aluminum (Al).

5. The method according to claim 1, wherein the aluminium-containing metallic binder is a mixture containing nickel (Ni), aluminum (Al) and chromium (Cr).

6. The method according to claim 1, wherein the chromium-containing metallic binder is a mixture containing nickel (Ni) and chromium (Cr).

7. The method according to claim 1, wherein the chromium-containing metallic binder is a mixture containing nickel (Ni), iron (Fe) and chromium (Cr).

8. The method according to claim 1, wherein the aluminium-containing intermetallic binder material is a mixture containing a nickel aluminides ($Ni_3Al$, NiAl).

9. The method according to claim 1, wherein at least one of the following substances is blended in the raw materials of the metal matrix composite: zirconium (Zr), zirconium oxide ($ZrO_2$), yttrium (Y), yttrium oxide ($Y_2O_3$), lanthanum (La), cerium (Ce), thorium (in), rhenium (Re), rhodium (Rh), titanium (Ti), silicon carbide (SiC), or molybdenum suicide ($MoSi_2$).

10. A metal matrix composite made by the SHS technique and comprising titanium carbide, and a metallic binder or an intermetallic binder material, characterized in that the metal matrix composite further comprises either a) chromium and a binder selected among aluminum-containing metallic binders, or aluminum-containing intermetallic binder materials, or b) tantalum, molybdenum, and a binder selected among aluminum-containing metallic binders, chromium-containing metallic binders, or aluminum-containing intermetallic binder materials, and a protective oxide layer builds up on the surface of the metal matrix composite during its use in a temperature range from 500° C. to 1200° C.

11. The metal matrix composite according to claim 10, wherein the thickness of the oxide layer is 1 to 50 $\mu$m.

12. The metal matrix composite according to claim 10, wherein the metal matrix composite is in the form of a solid piece or a powder.

* * * * *